US010597983B2

(12) United States Patent
Fripp et al.

(10) Patent No.: US 10,597,983 B2
(45) Date of Patent: Mar. 24, 2020

(54) HIGH FLOW SCREEN SYSTEM WITH DEGRADABLE PLUGS

(71) Applicant: HALLIBURTON ENERGY SERVICES, INC., Houston, TX (US)

(72) Inventors: Michael Fripp, Carrollton, TX (US); William Mark Richards, Flower Mount, TX (US); Thomas J. Frosell, Irving, TX (US); Stephen M. Greci, Little Elm, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 219 days.

(21) Appl. No.: 15/559,655

(22) PCT Filed: Dec. 19, 2016

(86) PCT No.: PCT/US2016/067503
§ 371 (c)(1),
(2) Date: Sep. 19, 2017

(87) PCT Pub. No.: WO2018/118003
PCT Pub. Date: Jun. 28, 2018

(65) Prior Publication Data

US 2019/0120026 A1 Apr. 25, 2019

(51) Int. Cl.
*E21B 43/04* (2006.01)
*E21B 34/06* (2006.01)
(Continued)

(52) U.S. Cl.
CPC ..... *E21B 43/045* (2013.01); *E21B 34/063* (2013.01); *E21B 34/14* (2013.01);
(Continued)

(58) Field of Classification Search
CPC ..... E21B 17/1078; E21B 2034/007; E21B 34/063; E21B 34/14; E21B 43/045; E21B 43/08
See application file for complete search history.

(56) References Cited

U.S. PATENT DOCUMENTS 5,320,178 A 6/1994 Cornette
5,355,956 A * 10/1994 Restarick ..... E21B 43/11 166/296

(Continued)

OTHER PUBLICATIONS

International Search Report and Written Opinion for International Application No. PCT/US2016/067503 dated Sep. 6, 2017 (16 pages).

*Primary Examiner* — Caroline N Butcher
(74) *Attorney, Agent, or Firm* — Haynes and Boone, LLP

(57) ABSTRACT

An apparatus and method according to which a zone of a wellbore that traverses a subterranean formation is completed. The apparatus includes a flow joint including a first internal flow passage, and a plurality of openings formed radially therethrough, a plurality of plugs disposed within the plurality of openings to form a fluid and pressure tight seal with the flow joint, thus impeding fluid flow through the plurality of openings, and a screen disposed exteriorly about the flow joint and axially along the plurality of openings, and thus also along the plurality of plugs, wherein, when the plurality of plugs are exposed to a downhole fluid, the plurality of plugs are adapted to degrade so that fluid flow is permitted through the plurality of openings. The plurality of plugs may include protective layers adapted to be damaged or removed to expose the plurality of plugs to the downhole fluid.

20 Claims, 9 Drawing Sheets

(51) Int. Cl.

| | |
|---|---|
| ***E21B 43/08*** | (2006.01) |
| ***E21B 34/14*** | (2006.01) |
| *E21B 17/10* | (2006.01) |
| *E21B 34/00* | (2006.01) |

(52) U.S. Cl.
CPC ..... *E21B 43/08* (2013.01); *E21B 17/1078* (2013.01); *E21B 2034/007* (2013.01)

(56) References Cited

U.S. PATENT DOCUMENTS

| | | | | |
|---|---|---|---|---|
| 7,451,815 | B2 | 11/2008 | Hailey, Jr. | |
| 2003/0075324 | A1 | 4/2003 | Dusterhoft et al. | |
| 2003/0141061 | A1* | 7/2003 | Hailey, Jr. ..... | E21B 34/06 166/278 |
| 2005/0121192 | A1* | 6/2005 | Hailey, Jr. ..... | E21B 43/045 166/278 |
| 2007/0039741 | A1* | 2/2007 | Hailey, Jr. ..... | E21B 34/10 166/376 |
| 2014/0305630 | A1* | 10/2014 | Kang ..... | E21B 34/063 166/205 |
| 2016/0130911 | A1* | 5/2016 | Allen ..... | E21B 33/124 166/280.1 |

* cited by examiner

HIGH FLOW SCREEN SYSTEM WITH DEGRADABLE PLUGS

TECHNICAL FIELD

The present disclosure relates generally to oil and gas operations and the equipment used therefor, and, more specifically, to enhancing the efficiency of a single trip multi-zone completion string by utilizing a high flow screen system with degradable plugs.

BACKGROUND

In the process of completing an oil or gas well, a tubular is run downhole and may be used to communicate injection or treatment fluids from the surface to the formation, or to communicate produced hydrocarbons from the formation to the surface. This tubular may be coupled to a filter assembly including a screen having multiple entry points at which the injection, treatment, or production fluid passes through the filter assembly. The screen is generally cylindrical and is wrapped around a base pipe having openings formed therein. It is often advantageous to impede fluid communication through the openings in the base pipe during installation of the filter assembly in the wellbore. Once the filter assembly is properly positioned in the wellbore, a particulate material may be packed around the filter assembly to form a permeable mass that allows fluid to flow therethrough while blocking the flow of formation materials into the downhole tubular. Fluid communication must be established through the openings in the base pipe at an appropriate time, and in a suitable manner, for the particular operation performed. Additionally, even after fluid communication is established through the openings in the base pipe, the filter assembly may become clogged and/or may experience erosion. For example, during injection, excessive velocity of the injection fluid can cause erosion of the screen adjacent the openings, excessive build-up of formation fines in the screen due to erosion of the particulate material packed around the filter assembly, and/or erosion or washout of proppant holding open induced fractures in the formation. Therefore, what is needed is a system, assembly, method, or apparatus that addresses one or more of these issues, and/or other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
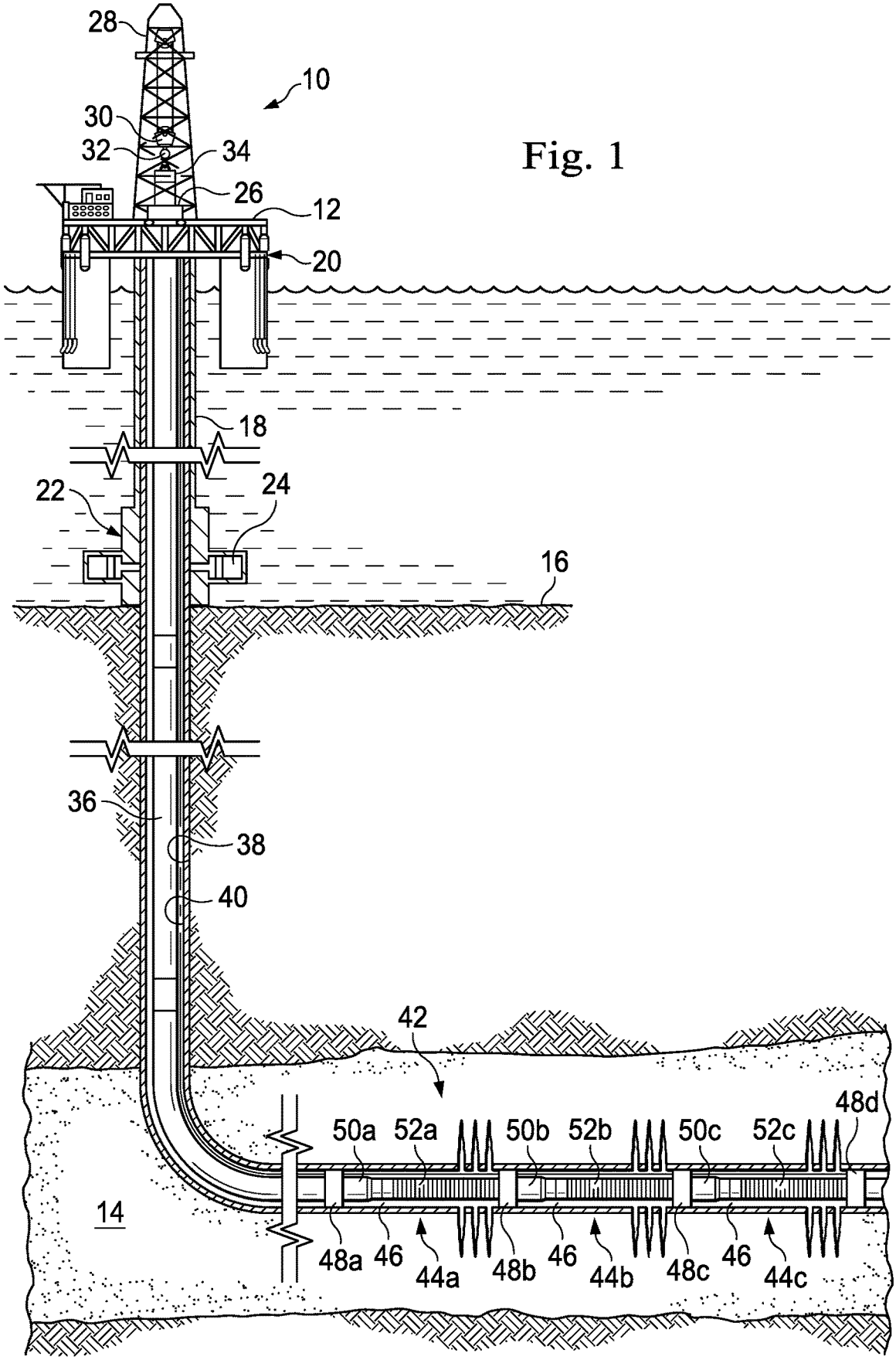
FIG. 1 is a schematic illustration of an offshore oil and gas platform operably coupled to a lower completion string disposed within a wellbore, according to an exemplary embodiment.

Illustrative embodiments and related methods of the present disclosure are described below as they might be employed in a high flow screen system with degradable plugs. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The following disclosure may repeat reference numerals and/or letters in the various examples or figures. This repetition is for the purpose of simplicity and clarity and does not in itself dictate a relationship between the various embodiments and/or configurations discussed. Further, it should be understood that the use of spatially relative terms such as "above," "below," "upper," "lower," "upward," "downward," "uphole," "downhole," and the like are used in relation to the illustrative embodiments as they are depicted in the figures, the upward and downward directions being toward the top and bottom of the corresponding figure, respectively, and the uphole and downhole directions being toward the surface and toe of the well, respectively. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although a figure may depict a horizontal wellbore or a vertical wellbore, unless indicated otherwise, it should be understood that the apparatus according to the present disclosure is equally well suited for use in wellbores having other orientations including vertical wellbores, horizontal wellbores, slanted wellbores, multilateral wellbores, or the like. Further, unless otherwise noted, even though a figure may depict an offshore operation, it should be understood that the apparatus according to the present disclosure is equally well suited for use in onshore operations. Finally, unless otherwise noted, even though a figure may depict a cased-hole wellbore, it should be understood that the apparatus according to the present disclosure is equally well suited for use in open-hole wellbore operations.

Referring to FIG. 1, an offshore oil and gas platform is schematically illustrated and generally designated by the reference numeral 10. In an exemplary embodiment, the offshore oil and gas platform 10 includes a semi-submersible platform 12 that is positioned over a submerged oil and gas formation 14 located below a sea floor 16. A subsea conduit 18 extends from a deck 20 of the platform 12 to a subsea wellhead installation 22. One or more pressure control devices 24, such as, for example, blowout preventers (BOPs), and/or other equipment associated with drilling or producing a wellbore may be provided at the subsea wellhead installation 22 or elsewhere in the system. The platform 12 may include a hoisting apparatus 26, a derrick 28, a travel block 30, a hook 32, and a swivel 34, which components are together operable for raising and lowering a conveyance vehicle 36.

A variety of conveyance vehicles 36 may be raised and lowered from the platform 12, such as, for example, casing, drill pipe, coiled tubing, production tubing, other types of pipe or tubing strings, and/or other types of conveyance vehicles, such as wireline, slickline, and the like. In the embodiment of FIG. 1, the conveyance vehicle 36 is a substantially tubular, axially extending tubular string made up of a plurality of pipe joints coupled to one another end-to-end. The platform 12 may also include a kelly, a rotary table, a top drive unit, and/or other equipment associated with the rotation and/or translation of the conveyance vehicle 36. A wellbore 38 extends from the subsea wellhead installation 22 and through the various earth strata, including the formation 14. At least a portion of the wellbore 38 may include a casing string 40 cemented therein. Connected to the conveyance vehicle 36 and extending within the wellbore 38 is a generally tubular lower completion string 42 in which the high flow screen system with degradable plugs of the present disclosure is incorporated.

In an exemplary embodiment, the lower completion string 42 is disposed in a substantially horizontal portion of the wellbore 38 and includes one or more completion sections 44 such as, for example, completion sections 44*a-c* corresponding to different zones of the formation 14. An annulus 46 is defined between the lower completion string 42 and the casing string 40. The lower completion string 42 further includes isolation packers 48*a-c*, packing valves 50*a-c*, filter assemblies 52*a-c*, and a sump packer 48*d*. Each completion section 44*a-c* includes respective ones of the isolation packers 48*a-c*, the packing valves 50*a-c*, and the filter assemblies 52*a-c*.

The packers 48*a-d* each form an annular seal between the casing string 40 and the lower completion string 42, thereby fluidically isolating the completion sections 44*a-c* from each other within the annulus 46. In an exemplary embodiment, one or more of the packers 48*a-d* is a hydraulic set packer. In several exemplary embodiments, one or more of the packers 48*a-d* is another type of packer that is not a hydraulic set packer, such as, for example, a mechanical set packer, a tension set packer, a rotation set packer, an inflatable packer, a swellable packer, another type of packer capable of sealing the annulus 46, or any combination thereof.

The packing valves 50*a-c* facilitate the fracturing or gravel-packing of each zone of the formation 14. Specifically, the packing valves 50*a-c* are adapted to direct the flow of a treatment fluid into the annulus 46. In several exemplary embodiments, the treatment fluid may include any fluid used to enhance production, injection, and/or other well treatment operations, such as, for example, a gravel slurry, a proppant slurry, a slurry including another granular media, hydrocarbons, a fracturing fluid, an acid, other fluids introduced or occurring naturally within the wellbore 38 or the formation 14, or any combination thereof.

The filter assemblies 52*a-c* control and limit debris such as gravel, sand, and other particulate matter from entering the lower completion string 42 and, thereafter, the conveyance vehicle 36. Several intervals of the casing string 40 are perforated adjacent the filter assemblies 50*a-c*, as shown in FIG. 1. The structure and operation of the filter assemblies 52*a-c* will be discussed in further detail below.

Generally, with continuing reference to FIG. 1, the operation of the lower completion string 42 includes communicating the treatment fluid from the surface to the completion section 44 within a work string (not shown) to perform injection or well treatment operations. During such injection or well treatment operations, the packing valve 50 directs the treatment fluid into the annulus 46. For example, in the case of a fracturing operation, the treatment fluid transports a particulate material (i.e., proppant) into the formation 14, thereby propping open induced fractures in the formation 14. Similarly, in the case of a gravel-packing operation, the treatment fluid transports a particulate material (i.e., gravel) to the annulus 46 to form a gravel-pack filter around the filter assembly 52. The gravel-pack filter is a permeable mass that prevents, or at least reduces, the flow of debris from the formation 14 into the filter assembly 52. Additionally, the operation of the lower completion string 42 may include producing hydrocarbons from the formation 14 via the wellbore 38 and the casing string 40. During such production operations, the filter assembly 52 and the gravel-pack filter control and limit debris such as gravel, sand, or other particulates from entering the lower completion string 42 and being communicated to the surface.

As indicated above, each completion section 44*a-c* includes respective ones of the isolation packers 48*a-c*, the packing valves 50*a-c*, and the filter assemblies 52*a-c*. The completion sections 44*a-c* are identical to one another and, therefore, in connection with FIGS. 2A-2C, 3A, 3B, and 4A-4C, only the completion section 44*c* will be described in detail below; however, the description below applies to every one of the completion sections 44*a-c*.

Figure 2A:
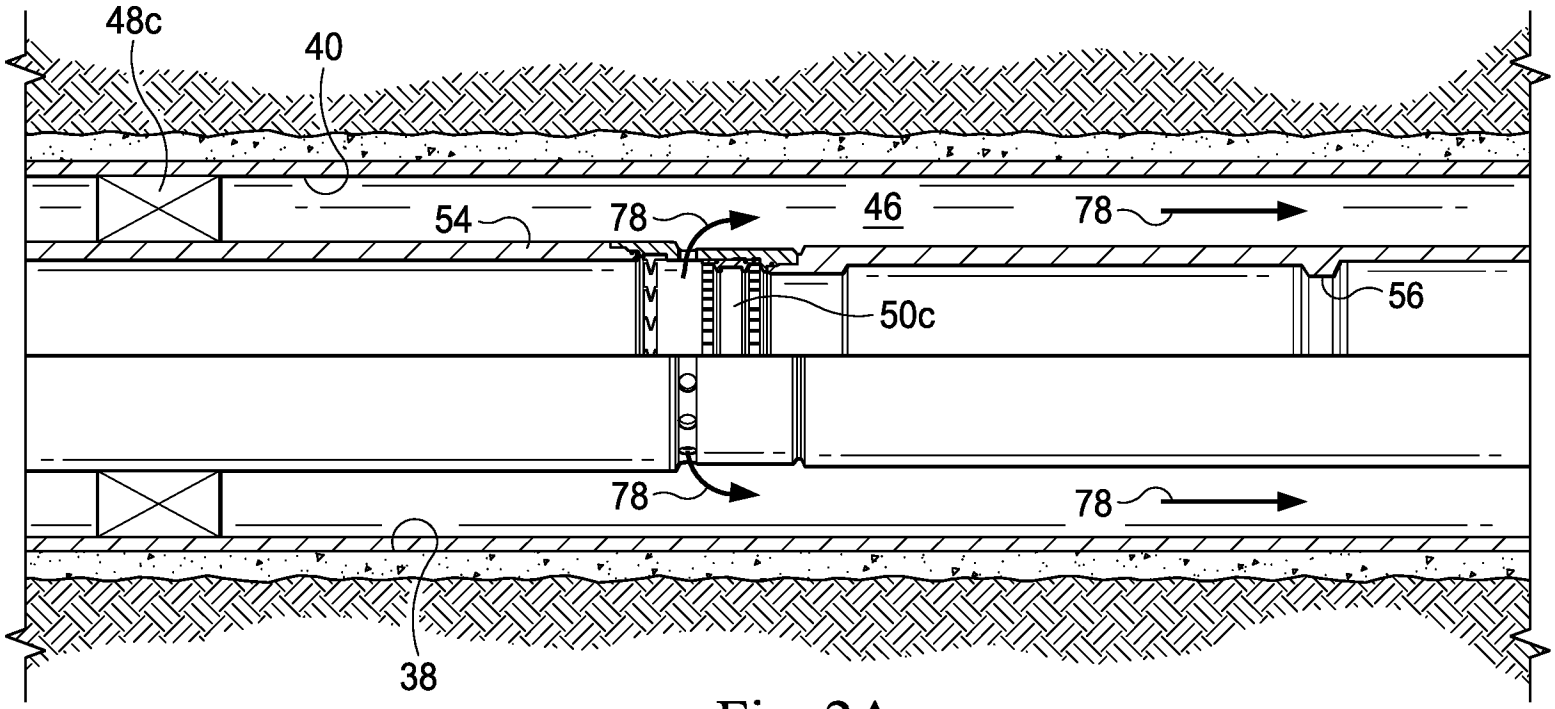
FIGS. 2A-2C are sectional views of a portion of the lower completion string of FIG. 1, the portion being configured for completions operations and including a flow joint, a fluid-return joint, and a flush joint, according to an exemplary embodiment.
Figure 2B:
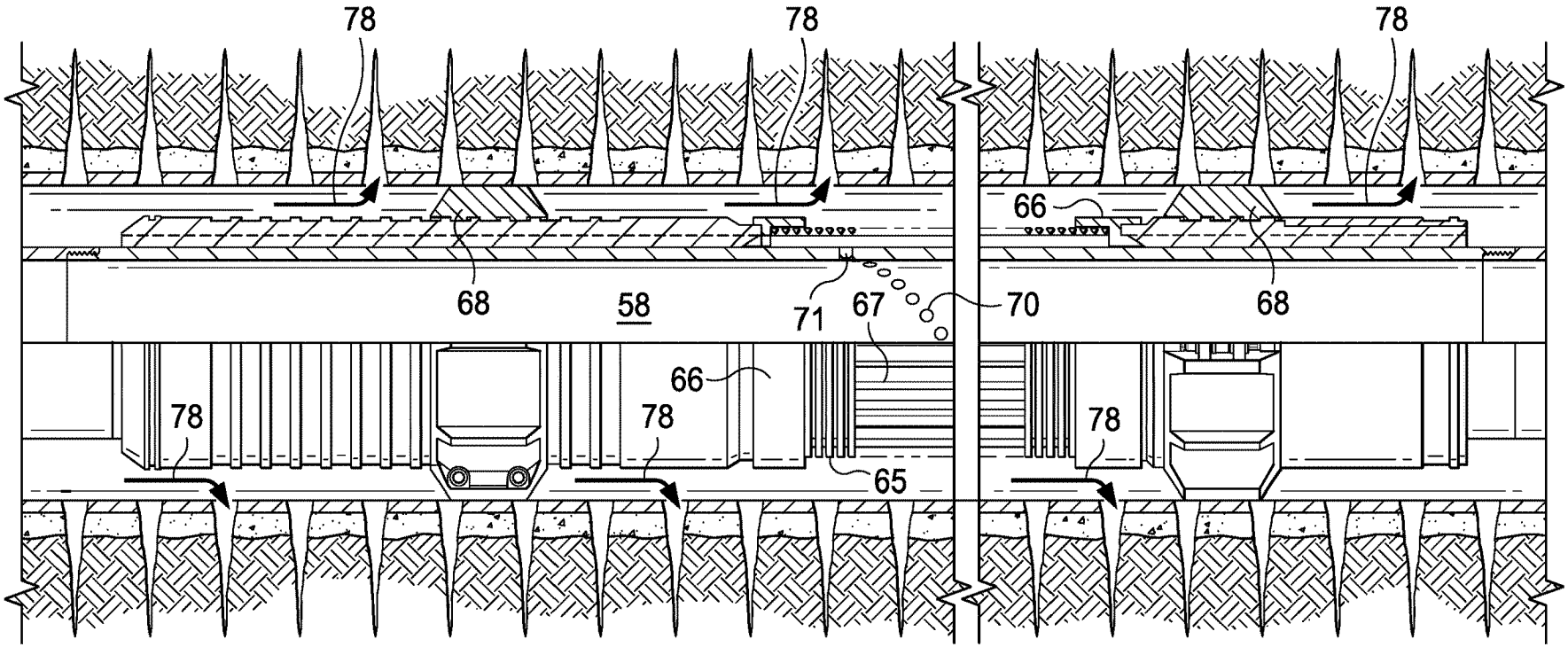
Figure 2C:
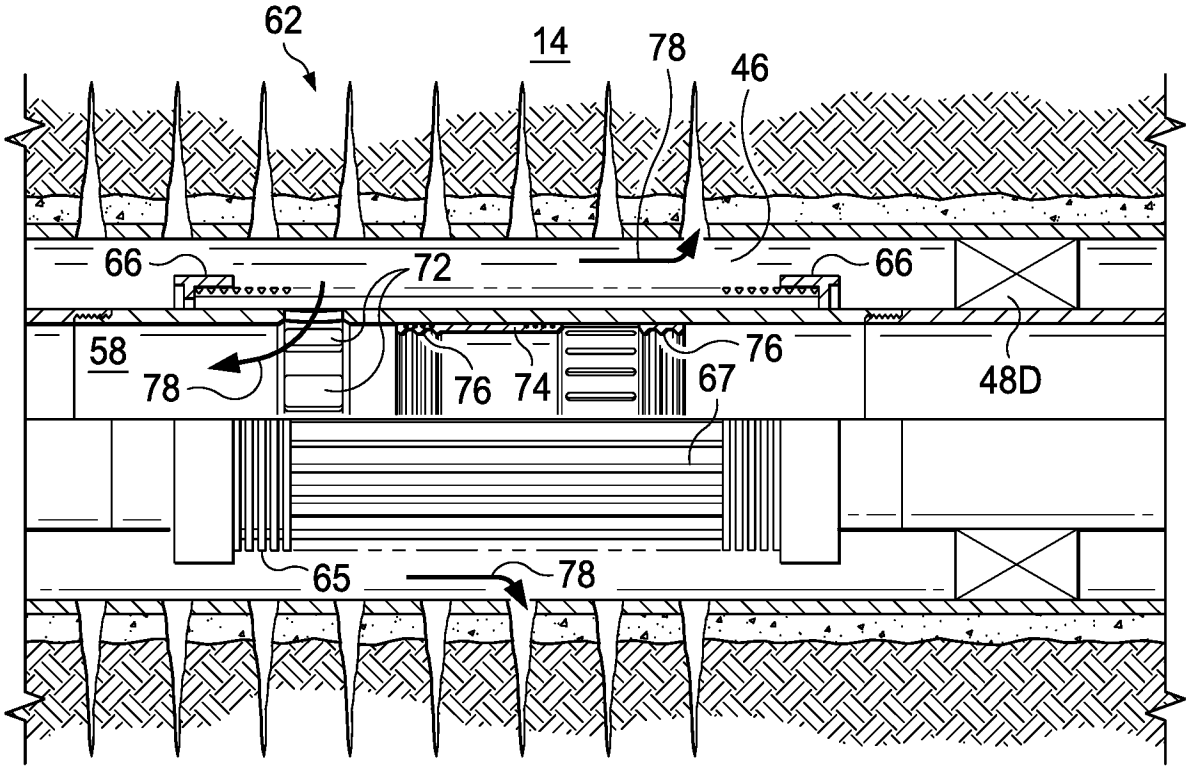

Referring now to FIGS. 2A-2C, with continuing reference to FIG. 1, an exemplary embodiment of the completion section 44*c* is illustrated. The completion section 44*c* includes an extension 54 extending between the isolation packer 48*c* and the packing valve 50*c* to space out the packing valve 50*c* below the isolation packer 48*c*, as shown in FIG. 2A. Additionally, an indicator collar 56 provides a contact surface for the weight down collet of a service tool (not shown) to rest on so that the crossover port of the service tool can direct the flow of the treatment fluid through the packing valve 50*c* and into the annulus 46.

The filter assembly 52*c* is positioned downhole from the packing valve 50, as shown in FIGS. 2B and 2C. The filter assembly 52*c* defines at least a portion of an internal flow passage 58 of the lower completion string 42. Additionally, the filter assembly 52*c* is made-up to include one or more each of the following generally tubular members, which overall extend from an upper end portion to a lower end portion of the filter assembly 52: flow joints 60, fluid-return joints 62, and, in some embodiments, flush joints 64. For example, in the embodiment of FIGS. 2A-2C, the filter assembly 52 includes one (1) of the flow joints 60, one (1) of the fluid-return joints 62, and one (1) of the flush joints 64. The filter assembly 52 further includes a screen 65 disposed exteriorly about the flow joints 60, the fluid-return joints 62, and/or the flush joints 64. In several exemplary embodiments, the screen 65 extends from the upper end portion to the lower end portion of the filter assembly 52. However, in the embodiment of FIGS. 2A-2C, the screen 65 includes a plurality of axially-spaced screen segments, with respective ones of the screen segments being disposed about respective portions of the filter assembly 52, such as, for example, the flow joints 60 and the fluid-return joints 62. The screen 65 may be incorporated into the filter assembly 52 using a variety of connectors 66 such as, for example, a shrink fit connector, a friction fit connector, a threaded connection, a nut and bolt, a weld, another mechanical connection, or any combination thereof.

In some embodiments, the screen 65 is a filter formed of wire or synthetic mesh wound or wrapped onto the filter assembly 52. In other embodiments, the screen 65 is made from a filter medium such as wire wraps, mesh, sintered material, pre-packed granular material, and/or other materials. The filter medium can be selected for the particular well environment to effectively filter out solids from the reservoir. In still other embodiments, the screen 65 is made from a shroud or tubing having slots, louvres, or slits formed therethrough. In several exemplary embodiment, an annular flow passage or drainage layer is formed beneath the screen 65 using standoff supports 67 arranged in parallel and circumferentially spaced to support the screen 65 in a radially spaced-apart relation from the flow joints 60, the fluid-return joints 62, and/or the flush joints 64. The annular flow passage may also be formed using corrugated metal, perforated tubes, or bent shapes to support the screen 65. In those embodiments where the screen 65 includes the axially-spaced screen segments, an alternate annular flow path (not shown) may be formed along those portions of the filter assembly 52 not covered by a respective one of the screen segments. The alternate annular flow path permits communication of the treatment fluid along the filter assembly 52 between respective annular flow paths defined by the screen segments.

Figure 3A:
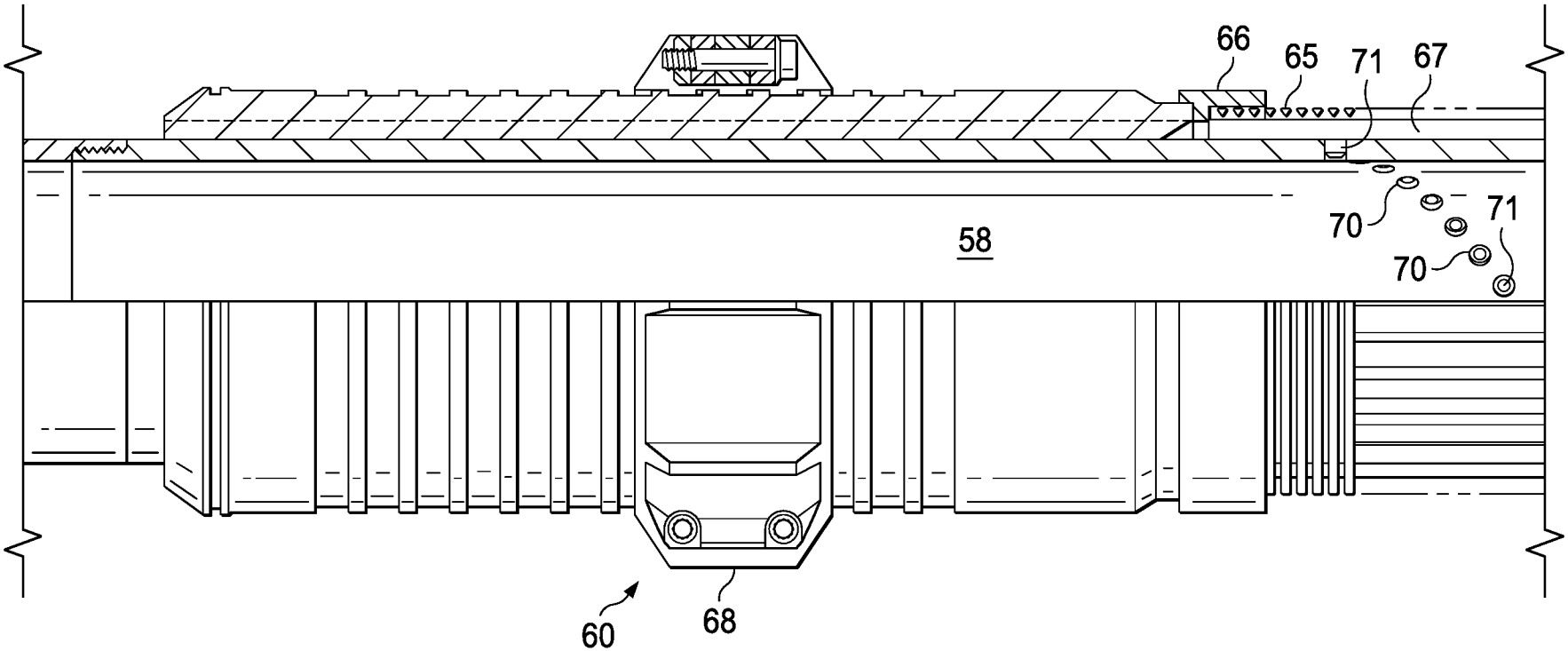
FIGS. 3A and 3B are sectional views of the flow joint of FIG. 2B, according to an exemplary embodiment.
Figure 3B:
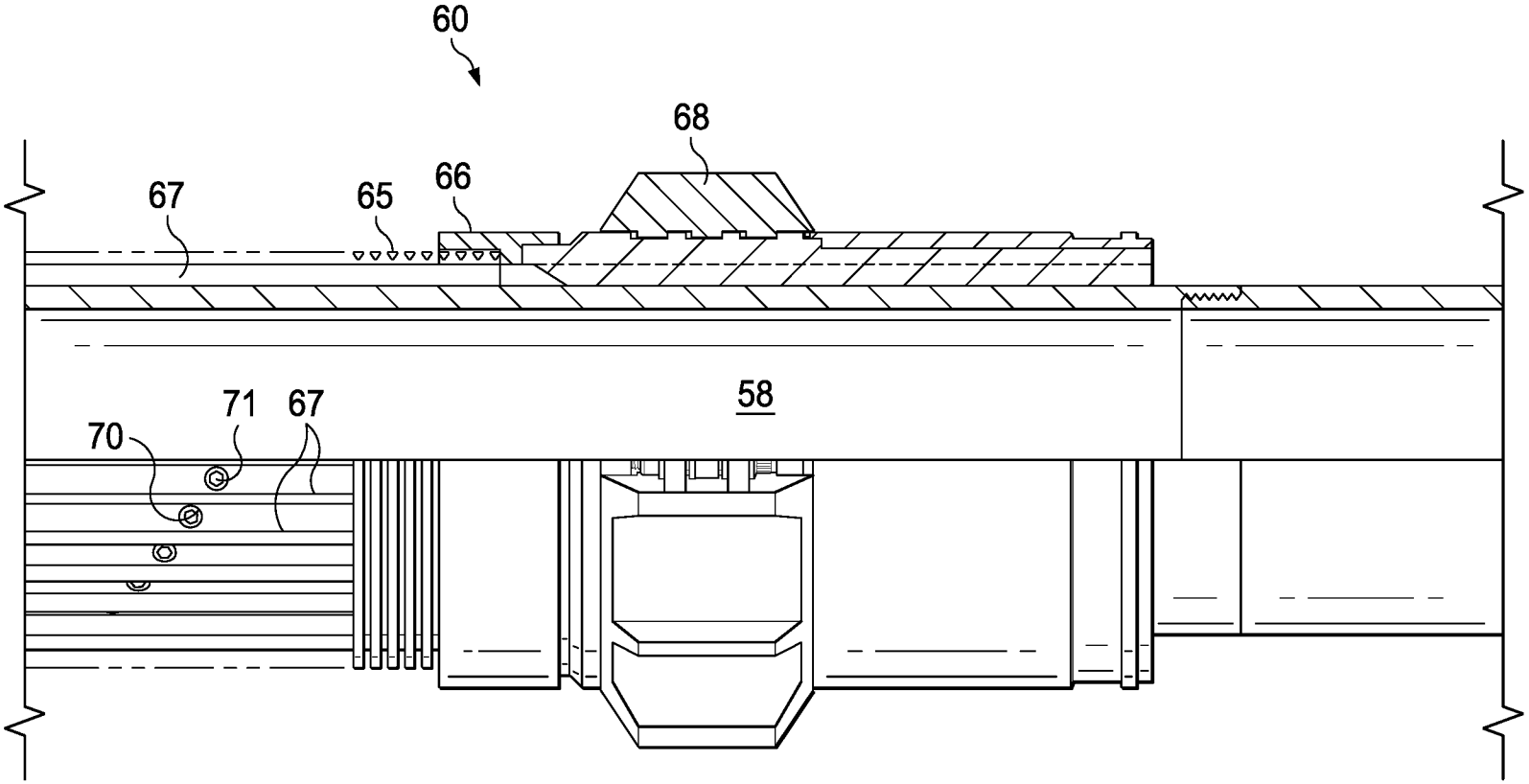

Referring to FIGS. 3A and 3B, one of the flow joints 60 is illustrated. In several exemplary embodiments, the flow joints 60 are substantially identical to one another, and, therefore, with reference to FIGS. 3A and 3B, only one of the flow joints 60 is described below. As shown in FIGS. 3A and 3B, the flow joint 60 defines a portion of the internal flow passage 58 of the filter assembly 52. A pair of centralizers 68 are incorporated into the flow joint 60 at opposing ends thereof. The centralizers 68 support the flow joint 60 within the wellbore 38 and/or the casing string 40 and maintain even spacing therebetween during well operations. A plurality of openings 70 are formed radially through the flow joint 60 beneath the screen 65. A plurality of plugs 71 are disposed within the openings 70 of the flow joint 60. The plugs 71 are installed in the openings 70 of the flow joint 60 by, for example, threading, swage operation, press-fitting, heat shrinking, another installation technique, or any combination thereof. The plugs 71 form a fluid and pressure tight seal with the flow joint 60 to prevent, or at least reduce, fluid flow through the openings 70. Moreover, the plugs 71 are capable of blocking, or at least obstructing, radial flow through the openings 70 of the flow joint 60 during installation of the lower completion string 42 into the wellbore 38. Alternatively, the plugs 71 may be adapted to partially prevent radial flow through the openings 70 (e.g., through the use of an orifice, a nozzle, or the like) and/or to permit radial flow through the openings 70 in only a single direction. The plugs 71 reduce the risk of damaging or clogging the filter assembly 52, especially the screen 65, during the installation thereof into the wellbore 38.

After the lower completion string 42 is installed in the wellbore 38, the plugs 71 are adapted to be at least partially degraded at an appropriate time, and in a suitable manner, for the specific operation performed in the wellbore 38, whether it be fracturing of the formation 14, gravel packing around the screen 65, injecting fluids into the formation 14, producing hydrocarbons from the formation 14, another wellbore operation, or some combination thereof. In several exemplary embodiments, at least respective portions of the plugs 71 are made of a material adapted to degrade in a fluid that is present in the wellbore 38 or the internal flow passage 58, thus eliminating the necessity for manual intervention in the wellbore 38 to remove the plugs 71 (e.g., using a retrieval tool). The term "degrade" is used herein to describe any chemical or physical process by which at least respective portions of the plugs 71 break down into particles small enough so as not to prevent fluid flow through the openings 70 of the flow joint 60. Degradation of the plugs 71 may be achieved using a variety of techniques, as will be discussed in further detail below. As a result of the degradation of the plugs 71, the openings 70 allow fluid to pass radially through the flow joint 60 between the internal flow passage 58 and the annulus 46.

Referring to FIG. 2C, an exemplary embodiment of the fluid-return joint 62 is illustrated. The fluid-return joint 62 defines a portion of the internal flow passage 58 of the filter assembly 52. A plurality of openings 72 are formed radially through the fluid-return joint 62 beneath the screen 65. A closure member, such as, for example, a fracturing ("frac") sleeve 74 extends interior to the openings 72 and is configured to sealingly and slidably engage the fluid-return joint 62. One or more selective shifting profiles 76 are formed in the interior of the frac sleeve 74 and configured to be engaged by a shifting tool (not shown). Engagement between the shifting tool and the selective shifting profiles 76 results from a set of shifting keys complementarily engaging at least one of the selective shifting profiles 76. The shifting keys are configured to bypass other profiles formed within the lower completion string 42, so as to engage only the selective shifting profiles 76. The frac sleeve 74 is thus actuable, via the shifting tool, between an open configuration, in which the frac sleeve 74 is axially offset from at least a portion (or respective portions) of the openings 72 to permit fluid flow therethrough, and a closed configuration, in which the frac sleeve 74 covers the openings 72 to prevent, or at least reduce, fluid flow therethrough. Alternatively, the frac sleeve 74 may be omitted from the fluid-return joint 62 in favor of some other closure member, such as, for example, degradable plugs.

In operation, as illustrated in FIGS. 2A-2C with continuing reference to FIG. 1, the formation 14 is stimulated by first setting the sump packer 48*d* and perforating the casing string 40 along different zones of the formation 14. The lower completion string 42 is then run downhole on a work string and the isolation packers 48*a-c* are set, thereby preventing, or at least reducing, fluid communication between the completion sections 44*a-c* within the annulus 46. During the lowering of the lower completion string 42 into the wellbore 38, the plugs 71 remain un-degraded, thus preventing fluid flow through the openings 70 of the flow joints 60. Beginning in the lowermost completion section 44*c*, a shifting tool (not shown) is displaced (via a service tool) to shift the frac sleeve 74 of the fluid-return joint 62 into the open configuration, as shown in FIG. 2C, thus permitting return flow of the treatment fluid to the surface during pumping operations. Alternatively, the frac sleeve 74 is left in the closed configuration during pumping operations so that return flow of the treatment fluid is prevented, or at least reduced.

Figure 4A:
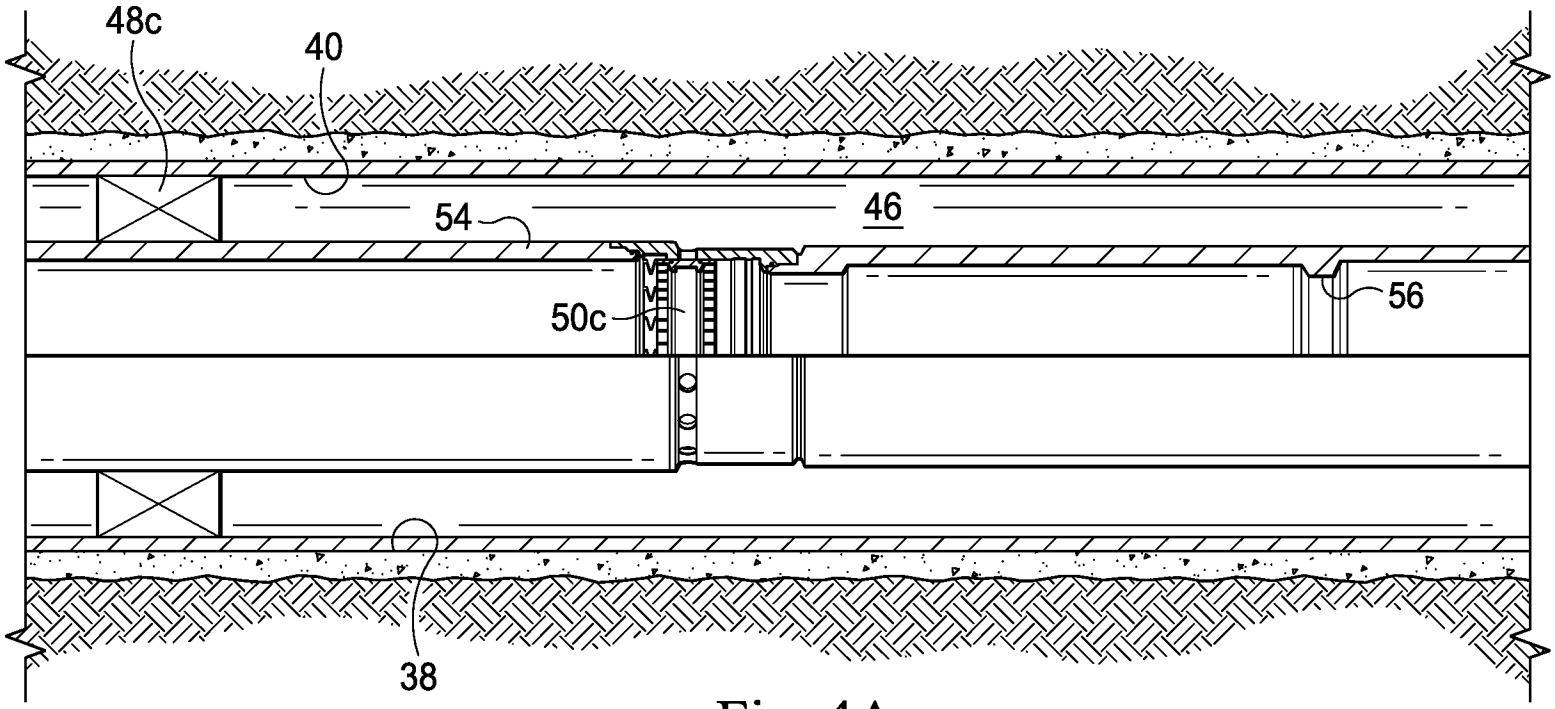
FIGS. 4A-4C are sectional views of the portion of the lower completion string of FIGS. 2A-2C, the portion being configured for injection operations, according to an exemplary embodiment.

To initiate pumping operations, the shifting tool is displaced (via the service tool) to shift open the packing valve 50*c* (as shown in FIG. 2A). Subsequently, a weight-down collet of the service tool is positioned on the indicator collar 56 to align the crossover port of the service tool with the packing valve 50*c*. Treatment fluid is then pumped downhole, through the crossover port and the packing valve 50*c*, and into the annulus 46, as indicated by arrows 78. The treatment fluid flows over the filter assembly 52*c*, along the perforated interval, and into the formation 14, thereby stimulating the formation 14 by at least one of: propping open induced fractures in the formation 14 with proppant; and packing gravel over the filter assembly 52 to provide a permeable mass 79 (shown in FIGS. 4B and 4C) which prevents, or at least reduces, the passage of formation particulates into the internal flow passage 58. The plugs 71 remain un-degraded during pumping operations, as shown in FIG. 2B. Once the formation 14 proximate the completion section 44*c* is stimulated, the shifting tool is displaced to close the packing valve 50*c* (as shown in FIG. 4A) and, if the frac sleeve 74 of the fluid-return joint 62 is not already in the closed configuration, to shift the frac sleeve 74 into the closed configuration (as shown in FIG. 4C). The above-described stimulation process is repeated for the completion sections 44*b* and 44*a*, with the work string progressing until each zone of the formation 14 is stimulated. Alternatively, the work string may be configured to complete the above-described stimulation process contemporaneously for the completion sections 44*a-c*.

Figure 4B:
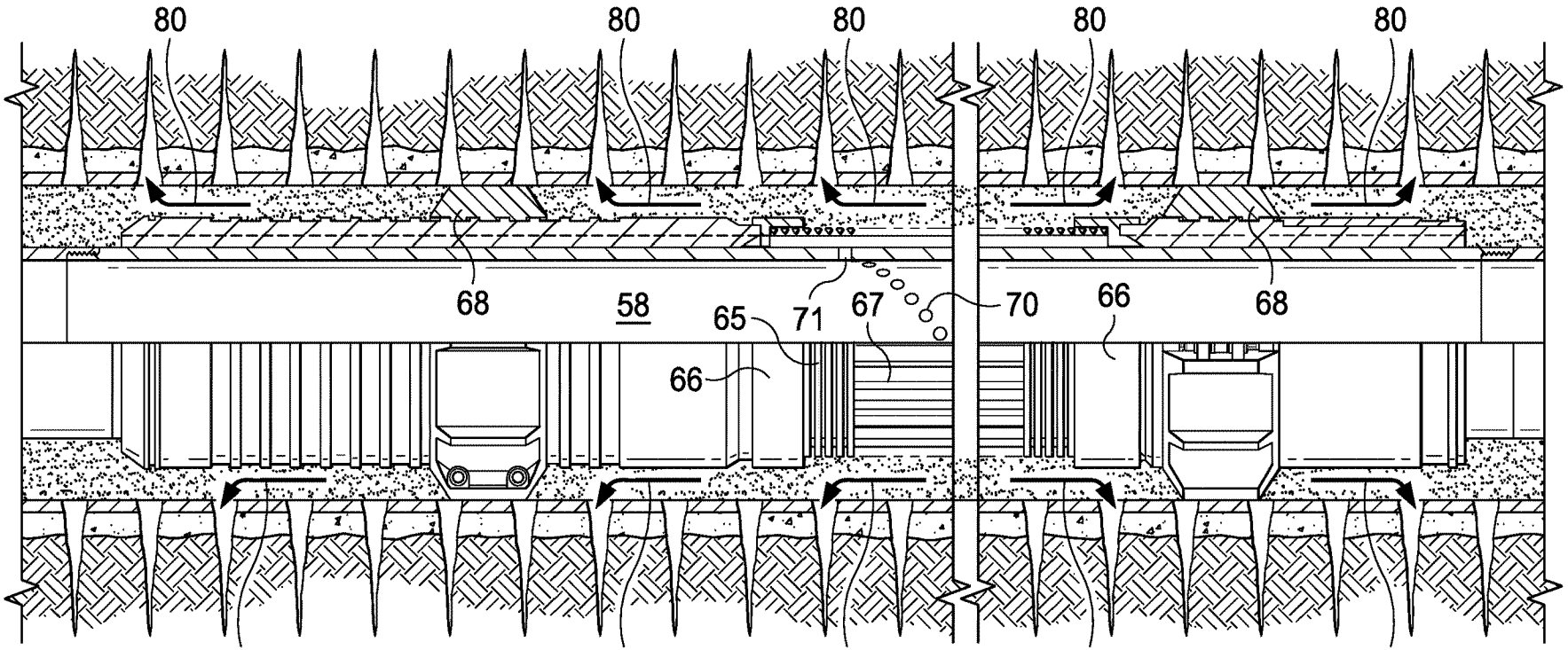
Figure 4C:
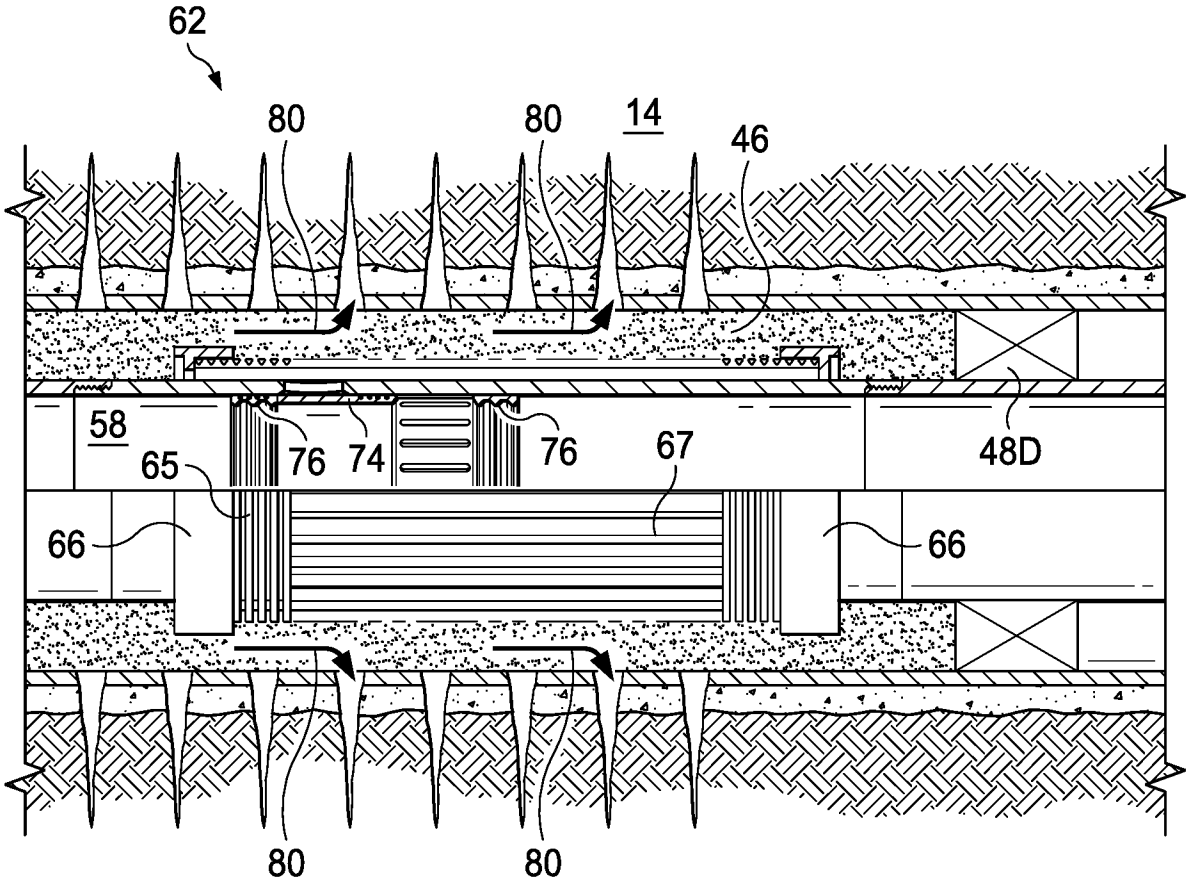

In an exemplary embodiment, as illustrated in FIGS. 4A-4C with continuing reference to FIG. 1, after the formation 14 has been stimulated as described above, the plugs 71 are at least partially degraded to facilitate further wellbore operations, such as, for example, injection operations, well treatment operations, production operations, or any combination thereof. In several exemplary embodiments, protective layers (not shown) are formed over the plugs 71 to prevent immediate activation of the degradation of the plugs 71. In those embodiments where the plugs 71 include the protective layers, the degradation of the plugs 71 is initiated by removing the protective layers through, for example, ablation, abrasion, erosion, perforation, heating, ripping, corrosion, scratching, blasting, and magnets, another removal process, or the like. The resultant damage or removal of the protective layers exposes the plugs 71 to fluids within the wellbore 38 or the internal flow passage 58. The fluids to which the plugs 71 are exposed when the protective layers are removed may include, but are not limited to, corrosive fluids, acidic fluids, electrolytic fluids, other fluids capable of degrading the plugs, or any combination thereof. The fluids trigger a chemical reaction that continues until the plugs 71 break down into particles small enough so as not to impede the radial flow of fluid through the openings 70 in the flow joints 60.

In several exemplary embodiments, the well is an injection well and, after the plugs 71 have been sufficiently degraded, injection operations are performed. To perform injection operations, an injection tubing string (not shown) is run downhole from the oil or gas platform 10 into the lower completion string 42. The injection tubing string is then sealingly engaged with the lower completion string 42 proximate one or more of the packers 48*a-d* so that perforated sections of the injection tubing string are positioned interior to one or more of the filter assemblies 52. An injection fluid is communicated to the internal flow passage 58 of the lower completion string 42 via the injection tubing string, as indicated by arrows 80 (shown in FIGS. 4B and 4C). The flow of the injection fluid from the internal flow passage 58 to the annulus 46 is controlled by the degradation of the plugs 71. Once the plugs 71 are sufficiently degraded, the injection fluid flows into the gravel-packed annulus 46 through the openings 70 in the flow joints 60, and, subsequently, into the formation 14 through the perforations in the casing string 40, thus causing hydrocarbons in the formation 14 to migrate away from the injection well and toward a production well in the same formation 14. In addition to, or instead of, the injection operations, the lower completion string 42 may be utilized for other well treatment operations and/or to produce hydrocarbons from the formation 14.

The velocity at which the injection fluid passes through the screen 65 during injection operations is dependent upon the size, quantity, and distribution of the openings 70 in the flow joints 60. That is, the velocity of the injection fluid decreases as the size, quantity, or distribution of the openings 70 in the flow joints 60 increases. In several exemplary embodiments, the size, quantity, and distribution of the openings 70 are configured to permit high flow rates during injection while preventing, or at least reducing, excessive velocities in the annulus 46 as the injection fluid exits the flow joints 60. The prevention or reduction of excessive velocities during injection prevents, or at least reduces: erosion of the screen 65 adjacent the flow joints 60; excessive build-up of formation fines in the filter assembly 52 due to erosion of the permeable mass 79 packed around the screen 65; and proppant erosion or washout from the induced fractures in the formation 14. In several exemplary embodiments, the injection fluid has a direct radial flow path (as opposed to an annular flow path) from the internal flow passage 58, through the openings 70 and the screen 65, and into the annulus 46, thereby preventing, or at least reducing, the likelihood of clogging inherent to an annular flow path.

In an exemplary embodiment, the flow joints 60 are placed at intervals in each filter assembly 52 separated by the flush joints 64. In an exemplary embodiment, the amount of total injection flow per filter assembly 52 can be adjusted by varying the number of flow joints 60 per filter assembly 52. In an exemplary embodiment, the amount of total injection flow per filter assembly 52 can be adjusted by selectively degrading the plugs 71 of one or more of the flow joints 60 in the filter assembly 52. In an exemplary embodiment, the amount of total injection flow per filter assembly 52 can be adjusted by varying the size, shape, pattern, and/or distribution of the openings 70 in the flow joints 60. In another exemplary embodiment, the flush joints 64 are omitted and the flow joints 60 are connected in series with one another, thereby providing the maximum percent possible of total injection flow per filter assembly 52.

In an exemplary embodiment, electric pressure and temperature gauges or fiber optic pressure and temperature gauges are run on the injection tubing string to measure pressure and temperature. In an exemplary embodiment, one or more inflow control devices (ICDs) are run on the injection tubing string to regulate the inflow into each zone of the formation 14. In an exemplary embodiment, a flow regulator is run on the injection tubing string to balance the injection flow into each zone. In an alternative embodiment, the injection tubing string is not run into the lower completion string 42, and zonal isolation is achieved by, for example, selectively degrading the plugs 71 of one or more of the flow joints 60 in the filter assembly 52.

In several exemplary embodiments, the protective layers of the plugs 71 are made of a material adapted to degrade at a significantly slower rate than the plugs 71 themselves, thus delaying the degradation of the plugs 71 until the protective layers have been sufficiently degraded. In several exemplary embodiments, the protective layers are made of a material that is non-reactive with the fluid in the wellbore 38 or the internal flow passage 58, such as, for example, a metal or a metal alloy having a high composition of copper, nickel, silver, chrome, gold, tin, lead, bismuth, platinum, or iron. In several exemplary embodiments, the protective layers are made of a material that erodes when exposed to a particular type of fluid such as, for example, a particle laden fluid.

In several exemplary embodiments, the protective layers are made of a material that softens or melts when exposed to a threshold temperature. In an exemplary embodiment, the threshold temperature is greater than a temperature that the plugs 71 encounter under normal operating conditions. For example, the temperature in the wellbore 38 or the internal flow passage 58 may be manipulated to exceed the threshold temperature and cause the protective layers to soften or melt.

In several exemplary embodiments, the protective layers are made of a material that fractures when exposed to a threshold pressure. In an exemplary embodiment, the threshold pressure is greater than a pressure that the plugs 71 encounter under normal operating conditions. For example, the pressure in the wellbore 38 or the internal flow passage 58 may be manipulated to exceed the threshold pressure and cause the protective layers to fracture.

In several exemplary embodiments, a jetting tool is run downhole to blast the interior of the plugs 71 with high pressure water, acid, or slurry blend, thus removing the protective layers of the plugs 71. In several exemplary embodiments, a scraper is run downhole to scrape off the protective layers of the plugs 71. The scraper has spring loaded keys that extend radially outward to contact the plugs 71 so that reciprocating motion of the scraper removes the protective layers of the plugs 71. Similarly, a casing brush may be used to scratch the protective layers of the plugs 71 that are flush or slightly recessed in the flow joints 60. In several exemplary embodiments, the protective layers of the plugs 71 include small metal beads or flakes that are removable by magnets. In those embodiments where the protective layers include small metal beads or flakes, magnets are run downhole on spring loaded keys that extend radially outward to contact the plugs 71 so that the strong magnetic field pulls the small metal particles off of the plugs 71.

In several exemplary embodiments, the degradation of the plugs 71 is achieved by, for example, dissolution in acid, salt water, and/or another fluid in the wellbore (whether introduced from the surface or present in the wellbore 38), galvanic corrosion, erosion by a nozzle or some other device, another mechanical or chemical process, or any combination thereof. In several exemplary embodiments, the composition of the plugs 71 is selected so that the plugs 71 begin to degrade within a predetermined time after initial exposure to a fluid in the wellbore 38 or the internal flow passage 58. In several exemplary embodiments, the composition of the plugs 71 is selected so that the rate at which the plugs 71 degrade is accelerated by adjusting the pressure, temperature, salinity, pH levels, or other characteristics of the fluid in the wellbore 38 or the internal flow passage 58.

In several exemplary embodiments, at least respective portions of the plugs 71 are made of a material adapted to galvanically react with a fluid that is present in the wellbore 38 or the internal flow passage 58. Specifically, the plugs 71 may include at least one electrode of a galvanic cell, e.g., such that respective portions of the plugs 71 form sacrificial anodes of the galvanic cell. Moreover, other portions of the plugs 71 may form cathodes of the galvanic cell. As a result, in the presence of an electrolyte, the plugs 71 (i.e., the anode) will undergo corrosion and break down into particles small enough so as to permit fluid flow through the openings 70 of the flow joint 60. In several exemplary embodiments, the galvanic reaction is delayed by preventing contact between the plugs 71 and the electrolytic fluid, through the use of a substance such as, for example, a coating (not shown). The coating may be dissolvable so that the galvanic reaction of the plugs 71 is delayed for a predetermined amount of time.

In several exemplary embodiments, at least respective portions of the plugs 71 are made of a metal or a metal alloy that is susceptible to degradation by fluid in the wellbore 38 or the internal flow passage 58, such as, for example, a metal or a metal alloy having a high composition of aluminum, magnesium, zinc, silver, and/or copper. For example, in an exemplary embodiment, at least respective portions of the plugs 71 are made of a magnesium alloy that is alloyed with a dopant. Alternatively, at least respective portions of the plugs 71 are made of an aluminum alloy that is alloyed with a dopant. Representative dopants include, but are not limited to, nickel, copper, aluminum, calcium, iron, tin, chromium, silver, gold, gallium, indium, palladium, zinc, zirconium, carbon, and/or other dopant materials.

In several exemplary embodiments, at least respective portions of the plugs 71 are made of a metal that dissolves via micro-galvanic corrosion. In several exemplary embodiments, at least respective portions of the plugs 71 are made of a metal pair that dissolves via galvanic corrosion. In several exemplary embodiments, at least respective portions of the plugs 71 are made of a metal that dissolves in an aqueous environment. In several exemplary embodiments, at least respective portions of the plugs 71 are made of a polymer that hydrolytically decomposes. In several exemplary embodiments, the metal from which the plugs 71 are constructed is a nanomatrix composite. In several exemplary embodiments, the metal from which the plugs 71 are constructed is a solid solution.

The present disclosure introduces a filter assembly adapted to extend within a wellbore that traverses a subterranean formation, the filter assembly including a flow joint including a first internal flow passage, and a first plurality of openings formed radially therethrough; a first plurality of plugs disposed within the first plurality of openings to form a fluid and pressure tight seal with the flow joint, thus impeding fluid flow through the first plurality of openings; and a screen disposed exteriorly about the flow joint and axially along the first plurality of openings, and thus also along the first plurality of plugs; wherein, when the first plurality of plugs are exposed to a downhole fluid, the first plurality of plugs are adapted to degrade so that fluid flow is permitted through the first plurality of openings. In an exemplary embodiment, the filter assembly further includes a fluid-return joint including a second internal flow passage in fluid communication with the first internal flow passage, a second plurality of openings formed radially therethrough, and a closure member that is actuable between: an open configuration, in which the closure member permits fluid flow through the second plurality of openings; and a closed configuration, in which the closure member impedes fluid flow through the second plurality of openings; wherein at least a portion of the screen is disposed exteriorly about the fluid-return joint and axially along the second plurality of openings. In an exemplary embodiment, the closure member includes a second plurality of plugs selectively removable from the second plurality of openings by a mechanical or chemical process. In an exemplary embodiment, the closure member includes a frac sleeve positioned interior to the second plurality of openings and configured to be engaged by a shifting tool to actuate the frac sleeve between the open and closed configurations. In an exemplary embodiment, the filter assembly further includes a granular media packed around the screen within the wellbore; wherein, when the first plurality of plugs are degraded so as to permit fluid flow through the first plurality of openings, fluid flows radially through the first plurality of openings at a velocity; and wherein one or more of the size, quantity, and distribution of the first plurality of openings are configured to minimize the velocity of the fluid flow therethrough so that at least one of: erosion of the screen adjacent the first plurality of openings; and washout of the granular media packed around the screen within the wellbore is prevented, or at least reduced. In an exemplary embodiment, the first plurality of plugs each include a protective layer adapted to be damaged or removed to expose the first plurality of plugs to the downhole fluid; and the protective layers of the first plurality of plugs are adapted to be damaged or removed by at least one of: ablation, abrasion, erosion, perforation, heating, ripping, corrosion, scratching, blasting, and magnets. In an exemplary embodiment, the first plurality of plugs includes at least one of: a metal that is susceptible to degradation by the downhole fluid, the metal having a high composition of at least one of: aluminum, magnesium, zinc, silver, and copper; and a metal alloyed with a dopant so as to be susceptible to degradation by the downhole fluid, the dopant including at least one of: nickel, copper, aluminum, calcium, iron, tin, chromium, silver, gold, gallium, palladium, indium, zinc, zirconium, and carbon. In an exemplary embodiment, the downhole fluid is an electrolytic fluid and respective portions of the first plurality of plugs include cathodes and anodes, respectively, of a galvanic cell; and, in the presence of the electrolytic fluid, the first plurality of plugs are adapted to corrode so that the first plurality of plugs no longer impede fluid flow through the first plurality of openings in the flow joint.

The present disclosure also introduces a completion section adapted to extend within a wellbore that traverses a subterranean formation, the completion section including: a packing valve adapted to direct the flow of a treatment fluid into the wellbore when the completion section is disposed within the wellbore; a filter assembly adapted to be positioned downhole from the packing valve when the completion section is disposed within the wellbore, the filter assembly including: a flow joint including a first internal flow passage, and a first plurality of openings formed radially therethrough; a fluid-return joint including a second internal flow passage in fluid communication with the first internal flow passage, and a second plurality of openings formed radially therethrough; a first plurality of plugs disposed within the first plurality of openings to form a fluid and pressure tight seal with the flow joint, thus impeding fluid flow through the first plurality of openings, wherein, when the first plurality of plugs are exposed to a downhole fluid, the first plurality of plugs are adapted to degrade so that fluid flow is permitted through the first plurality of openings; and a screen disposed exteriorly about the flow joint and the fluid-return joint, axially along the first plurality of openings and the second plurality of openings, and thus also along the first plurality of plugs. In an exemplary embodiment, the completion section further includes a granular media packed around the screen within the wellbore; wherein, when the first plurality of plugs are degraded so as to permit fluid flow through the first plurality of openings, fluid flows radially through the first plurality of openings at a velocity; and wherein one or more of the size, quantity, and distribution of the first plurality of openings are configured to minimize the velocity of the fluid flow therethrough so that at least one of: erosion of the screen adjacent the first plurality of openings; and washout of the granular media packed around the screen within the wellbore is prevented, or at least reduced. In an exemplary embodiment, the first plurality of plugs each include a protective layer adapted to be damaged or removed to expose the first plurality of plugs to the downhole fluid; and the protective layers of the first plurality of plugs are adapted to be damaged or removed by at least one of: ablation, abrasion, erosion, perforation, heating, ripping, corrosion, scratching, blasting, and magnets. In an exemplary embodiment, the downhole fluid is an electrolytic fluid and respective portions of the first plurality of plugs include cathodes and anodes, respectively, of a galvanic cell; and, in the presence of the electrolytic fluid, the first plurality of plugs are adapted to corrode so that the first plurality of plugs no longer impede fluid flow through the first plurality of openings in the flow joint. In an exemplary embodiment, the first plurality of plugs includes at least one of: a metal that is susceptible to degradation by the downhole fluid, the metal having a high composition of at least one of: aluminum, magnesium, zinc, silver, and copper; and a metal alloyed with a dopant so as to be susceptible to degradation by the downhole fluid, the dopant including at least one of: nickel, copper, aluminum, calcium, iron, tin, chromium, silver, gold, gallium, palladium, indium, zinc, zirconium, and carbon. In an exemplary embodiment, the fluid-return joint further includes a closure member that is actuable between: an open configuration, in which the closure member permits fluid flow through the second plurality of openings; and a closed configuration, in which the closure member impedes fluid flow through the second plurality of openings. In an exemplary embodiment, the closure member includes a second plurality of plugs selectively removable from the second plurality of openings by a mechanical or chemical process. In an exemplary embodiment, the closure member includes a frac sleeve positioned interior to the second plurality of openings and configured to be engaged by a shifting tool to actuate the frac sleeve between the open and closed configurations.

The present disclosure also introduces a method of completing a zone of a wellbore that traverses a subterranean formation, the method including introducing a completion section into the wellbore adjacent the zone, the completion section including: a packing valve; and a filter assembly positioned downhole from the packing valve, the filter assembly including: a flow joint having a first internal flow passage, and a plurality of openings formed radially therethrough; a plurality of plugs disposed within the plurality of openings to form a fluid and pressure tight seal with the flow joint, thus impeding fluid flow through the plurality of openings; and a screen disposed exteriorly about the flow joint and axially along the plurality of openings, and thus also along the plurality of plugs; directing the flow of a treatment fluid from the completion section into the wellbore, via the packing valve, to facilitate at least one of: packing a granular media around the filter assembly within the wellbore and fracturing the zone; and degrading the plurality of plugs with a downhole fluid so that radial fluid flow is permitted through the plurality of openings. In an exemplary embodiment, the method further includes damaging or removing protective layers of the plurality of plugs to expose the plurality of plugs to the downhole fluid, wherein the protective layers of the plurality of plugs are adapted to be damaged or removed by at least one of: ablation, abrasion, erosion, perforation, heating, ripping, corrosion, scratching, blasting, and magnets. In an exemplary embodiment, directing the flow of the treatment fluid from the completion section into the wellbore, via the packing valve, facilitates packing the granular media around the screen within the wellbore; wherein, when the plurality of plugs are degraded with the downhole fluid, fluid flows radially through the plurality of openings at a velocity; and wherein one or more of the size, quantity, and distribution of the plurality of openings are configured to minimize the velocity of the fluid flow therethrough so that at least one of: erosion of the screen adjacent the plurality of openings; and washout of the granular media packed around the screen within the wellbore is prevented, or at least reduced. In an exemplary embodiment, the plurality of plugs includes at least one of: a metal that is susceptible to degradation by the downhole fluid, the metal having a high composition of at least one of: aluminum, magnesium, zinc, silver, and copper; and a metal alloyed with a dopant so as to be susceptible to degradation by the downhole fluid, the dopant including at least one of: nickel, copper, aluminum, calcium, iron, tin, chromium, silver, gold, gallium, palladium, indium, zinc, zirconium, and carbon. In an exemplary embodiment, the downhole fluid is an electrolytic fluid and respective portions of the plurality of plugs include cathodes and anodes, respectively, of a galvanic cell; and, in the presence of the electrolytic fluid, the plurality of plugs are adapted to corrode so that the plurality of plugs no longer impede fluid flow through the plurality of openings in the flow joint.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A filter assembly adapted to extend within a wellbore that traverses a subterranean formation, the filter assembly comprising:

a flow joint comprising a first internal flow passage, and a first plurality of openings formed radially therethrough;

a first plurality of plugs disposed within the first plurality of openings to form a fluid and pressure tight seal with the flow joint, thus impeding fluid flow through the first plurality of openings;

a screen disposed exteriorly about the flow joint and axially along the first plurality of openings, and thus also along the first plurality of plugs; and a fluid-return joint comprising a second internal flow passage in fluid communication with the first internal flow passage, a second plurality of openings formed radially therethrough, and a closure member that is actuable between:

an open configuration, in which the closure member permits radially inward fluid flow through the second plurality of openings; and a closed configuration, in which the closure member prevents, or at least reduces, radially inward fluid flow through the second plurality of openings;

wherein, when the first plurality of plugs are exposed to a downhole fluid, the first plurality of plugs are adapted to degrade so that fluid flow is permitted through the first plurality of openings.

2. The filter assembly of claim 1, wherein at least a portion of the screen is disposed exteriorly about the fluid-return joint and axially along the second plurality of openings.

3. The filter assembly of claim 2, wherein the closure member comprises a second plurality of plugs selectively removable from the second plurality of openings by a mechanical or chemical process.

4. The filter assembly of claim 2, wherein the closure member comprises a frac sleeve positioned interior to the second plurality of openings and configured to be engaged by a shifting tool to actuate the frac sleeve between the open and closed configurations.

5. The filter assembly of claim 1, further comprising a granular media packed around the screen within the wellbore;

wherein, when the first plurality of plugs are degraded so as to permit fluid flow through the first plurality of openings, fluid flows radially through the first plurality of openings at a velocity; and wherein a size, a quantity, and/or a distribution of the first plurality of openings is/are configured to minimize the velocity of the fluid flow therethrough so that erosion of the screen adjacent the first plurality of openings and/or washout of the granular media packed around the screen within the wellbore is prevented, or at least reduced.

6. The filter assembly of claim 1, wherein the first plurality of plugs each include a protective layer adapted to be damaged or removed to expose the first plurality of plugs to the downhole fluid; and wherein the protective layers of the first plurality of plugs are adapted to be damaged or removed by ablation, abrasion, erosion, perforation, heating, ripping, corrosion, scratching, blasting, and/or magnets.

7. The filter assembly of claim 1, wherein the first plurality of plugs comprises:

a metal that is susceptible to degradation by the downhole fluid, the metal comprising aluminum, magnesium, zinc, silver, and/or copper; and/or a metal alloyed with a dopant so as to be susceptible to degradation by the downhole fluid, the dopant comprising nickel, copper, aluminum, calcium, iron, tin, chromium, silver, gold, gallium, palladium, indium, zinc, zirconium, and/or carbon.

8. The filter assembly of claim 1, wherein the downhole fluid is an electrolytic fluid and respective portions of the first plurality of plugs comprise cathodes and anodes, respectively, of a galvanic cell; and wherein, in the presence of the electrolytic fluid, the first plurality of plugs are adapted to corrode so that the first plurality of plugs no longer impede fluid flow through the first plurality of openings in the flow joint.

9. A completion section adapted to extend within a wellbore that traverses a subterranean formation, the completion section comprising:

a packing valve adapted to direct the flow of a treatment fluid into the wellbore when the completion section is disposed within the wellbore;

a filter assembly adapted to be positioned downhole from the packing valve when the completion section is disposed within the wellbore, the filter assembly comprising:

a flow joint comprising a first internal flow passage, and a first plurality of openings formed radially therethrough;

a fluid-return joint comprising a second internal flow passage in fluid communication with the first internal flow passage, a second plurality of openings formed radially therethrough, and a closure member that is actuable between:

an open configuration, in which the closure member permits radially inward fluid flow through the second plurality of openings; and a closed configuration, in which the closure member prevents, or at least reduces, radially inward fluid flow through the second plurality of openings;

a first plurality of plugs disposed within the first plurality of openings to form a fluid and pressure tight seal with the flow joint, thus impeding fluid flow through the first plurality of openings, wherein, when the first plurality of plugs are exposed to a downhole fluid, the first plurality of plugs are adapted to degrade so that fluid flow is permitted through the first plurality of openings;

a screen disposed exteriorly about the flow joint and the fluid-return joint, axially along the first plurality of openings and the second plurality of openings, and thus also along the first plurality of plugs.

10. The completion section of claim 9, further comprising a granular media packed around the screen within the wellbore;

wherein, when the first plurality of plugs are degraded so as to permit fluid flow through the first plurality of openings, fluid flows radially through the first plurality of openings at a velocity; and wherein a size, a quantity, and/or a distribution of the first plurality of openings is/are configured to minimize the velocity of the fluid flow therethrough so that erosion of the screen adjacent the first plurality of openings and/or washout of the granular media packed around the screen within the wellbore is prevented, or at least reduced.

11. The completion section of claim 9, wherein the first plurality of plugs each include a protective layer adapted to be damaged or removed to expose the first plurality of plugs to the downhole fluid; and wherein the protective layers of the first plurality of plugs are adapted to be damaged or removed by ablation, abrasion, erosion, perforation, heating, ripping, corrosion, scratching, blasting, and/or magnets.

12. The completion section of claim 9, wherein the downhole fluid is an electrolytic fluid and respective portions of the first plurality of plugs comprise cathodes and anodes, respectively, of a galvanic cell; and wherein, in the presence of the electrolytic fluid, the first plurality of plugs are adapted to corrode so that the first plurality of plugs no longer impede fluid flow through the first plurality of openings in the flow joint.

13. The completion section of claim 9, wherein the first plurality of plugs comprises:

a metal that is susceptible to degradation by the downhole fluid, the metal comprising aluminum, magnesium, zinc, silver, and/or copper; and/or a metal alloyed with a dopant so as to be susceptible to degradation by the downhole fluid, the dopant comprising nickel, copper, aluminum, calcium, iron, tin, chromium, silver, gold, gallium, palladium, indium, zinc, zirconium, and/or carbon.

14. The completion section of claim 9, wherein the closure member comprises a second plurality of plugs selectively removable from the second plurality of openings by a mechanical or chemical process.

15. The completion section of claim 9, wherein the closure member comprises a frac sleeve positioned interior to the second plurality of openings and configured to be engaged by a shifting tool to actuate the frac sleeve between the open and closed configurations.

16. A method of completing a zone of a wellbore that traverses a subterranean formation, the method comprising:

introducing a completion section into the wellbore adjacent the zone, the completion section comprising:

a packing valve; and a filter assembly positioned downhole from the packing valve, the filter assembly comprising:

a flow joint having a first internal flow passage, and a first plurality of openings formed radially therethrough;

a plurality of plugs disposed within the first plurality of openings to form a fluid and pressure tight seal with the flow joint, thus impeding fluid flow through the first plurality of openings;

a fluid-return joint having a second internal flow passage in fluid communication with the first internal flow passage, a second plurality of openings formed radially therethrough, and a closure member; and a screen disposed exteriorly about the flow joint and the fluid-return joint, axially along the first plurality of openings and the second plurality of openings, and thus also along the plurality of plugs;

directing the flow of a treatment fluid from the completion section into the wellbore, via the packing valve, to facilitate at packing a granular media around the filter assembly within the wellbore fracturing the zone, and/or degrading the plurality of plugs with a downhole fluid so that radial fluid flow is permitted through the plurality of openings; and actuating the closure member of the fluid-return joint between an open configuration, in which the closure member permits radially inward fluid flow through the second plurality of openings, and a closed configuration, in which the closure member prevents, or at least reduces, radially inward fluid flow through the second plurality of openings.

17. The method of claim 16, further comprising damaging or removing protective layers of the plurality of plugs to expose the plurality of plugs to the downhole fluid, wherein the protective layers of the plurality of plugs are adapted to be damaged or removed by ablation, abrasion, erosion, perforation, heating, ripping, corrosion, scratching, blasting, and/or magnets.

18. The method of claim 16, wherein directing the flow of the treatment fluid from the completion section into the wellbore, via the packing valve, facilitates packing the granular media around the screen within the wellbore;

wherein, when the plurality of plugs are degraded with the downhole fluid, fluid flows radially through the plurality of openings at a velocity; and wherein a size, a quantity, and/or a distribution of the plurality of openings is/are configured to minimize the velocity of the fluid flow therethrough so that erosion of the screen adjacent the plurality of openings and/or washout of the granular media packed around the screen within the wellbore is prevented, or at least reduced.

19. The method of claim 16, wherein the plurality of plugs comprises:

a metal that is susceptible to degradation by the downhole fluid, the metal comprising aluminum, magnesium, zinc, silver, and/or copper; and/or a metal alloyed with a dopant so as to be susceptible to degradation by the downhole fluid, the dopant comprising nickel, copper, aluminum, calcium, iron, tin, chromium, silver, gold, gallium, palladium, indium, zinc, zirconium, and/or carbon.

20. The method of claim 16, wherein the downhole fluid is an electrolytic fluid and respective portions of the plurality of plugs comprise cathodes and anodes, respectively, of a galvanic cell; and wherein, in the presence of the electrolytic fluid, the plurality of plugs are adapted to corrode so that the plurality of plugs no longer impede fluid flow through the plurality of openings in the flow joint.

* * * * *